US010125787B2

(12) United States Patent
Rendel et al.

(10) Patent No.: US 10,125,787 B2
(45) Date of Patent: Nov. 13, 2018

(54) HOUSING OF A CENTRIFUGAL BLOWER

(71) Applicant: MAHLE International GmbH, Stuttgart (DE)

(72) Inventors: Michael Rendel, Rutesheim (DE); Norman Schaake, Markgroeningen (DE); Joerg Kilian, Renningen (DE)

(73) Assignee: MAHLE International GmbH, Stuttgart (DE)

( * ) Notice: Subject to any disclaimer, the term of this patent is extended or adjusted under 35 U.S.C. 154(b) by 422 days.

(21) Appl. No.: 14/676,413

(22) Filed: Apr. 1, 2015

(65) Prior Publication Data

US 2015/0275915 A1 Oct. 1, 2015

(30) Foreign Application Priority Data

Apr. 1, 2014 (DE) ..... 10 2014 206 114

(51) Int. Cl.

| | |
|---|---|
| ***F04D 29/42*** | (2006.01) |
| ***F04D 17/10*** | (2006.01) |
| ***F04D 29/44*** | (2006.01) |
| ***F04D 29/66*** | (2006.01) |

(52) U.S. Cl.

CPC ..... *F04D 29/4233* (2013.01); *F04D 17/10* (2013.01); *F04D 29/422* (2013.01); *F04D 29/4226* (2013.01); *F04D 29/441* (2013.01); *F04D 29/664* (2013.01); *F04D 29/665* (2013.01)

(58) Field of Classification Search

CPC ..... F04D 29/4233; F04D 29/665; F04D 29/4226; F04D 29/664; F04D 29/422; F04D 17/10; F04D 29/441

See application file for complete search history.

(56) References Cited

U.S. PATENT DOCUMENTS 2,160,666 A * 5/1939 McMahan ..... F04D 29/281 181/207
2,225,398 A * 12/1940 Hamblin ..... F04D 29/665 181/257
2,642,219 A * 6/1953 Heath ..... F04D 29/424 415/204

(Continued)

FOREIGN PATENT DOCUMENTS

DE 26 28 511 A1 1/1977
DE 26 22 969 A1 11/1977
DE 10123275 A1 * 11/2002 ..... F04D 29/4226

(Continued)

*Primary Examiner* — Eldon Brockman

(74) *Attorney, Agent, or Firm* — Muncy, Geissler, Olds & Lowe, P.C.

(57) ABSTRACT

A housing of a centrifugal blower for use in an air conditioner is provided that includes a rotatably supported fan wheel, an inlet opening disposed in the axial direction of the fan wheel and an outlet opening disposed in the radial direction of the fan wheel. A widening diffuser is disposed downstream from the outlet opening in the flow direction, and the fan wheel is disposed in an inner volume of the housing. A crossover area formed from multiple openings is provided on at least one housing wall which delimits the inner volume. At least one chamber is disposed on the outside of the housing, the chamber completely covering the crossover area and being fluidically connected to the inner volume of the housing via the crossover area.

9 Claims, 4 Drawing Sheets

(56) References Cited

U.S. PATENT DOCUMENTS

| | | | | | |
|---|---|---|---|---|---|
| 3,174,682 | A * | 3/1965 | Wilfert | B60H 1/00471 | 415/119 |
| 3,286,914 | A * | 11/1966 | Baverstock | F04D 29/668 | 415/119 |
| 3,312,389 | A * | 4/1967 | Matsui | F04D 29/664 | 415/119 |
| 3,540,547 | A * | 11/1970 | Waddell, Jr. | F04D 29/664 | 181/225 |
| 4,174,020 | A * | 11/1979 | Challis | F04D 29/424 | 181/211 |
| 5,199,846 | A * | 4/1993 | Fukasaku | F04D 29/664 | 181/224 |
| 5,915,922 | A * | 6/1999 | Wiethe | D06F 58/04 | 415/119 |
| 6,454,527 | B2 * | 9/2002 | Nishiyama | F01P 11/12 | 264/51 |
| 8,231,331 | B2 * | 7/2012 | Wu | F04D 29/4226 | 415/119 |
| 8,272,834 | B2 * | 9/2012 | Lefevre | F04D 29/665 | 415/119 |
| 2002/0015640 | A1 * | 2/2002 | Nishiyama | F01P 11/12 | 415/119 |
| 2008/0292449 | A1 * | 11/2008 | Lefevre | F04D 29/665 | 415/58.4 |
| 2009/0232648 | A1 * | 9/2009 | Wu | F04D 29/4226 | 415/204 |

FOREIGN PATENT DOCUMENTS

| | | | |
|---|---|---|---|
| FR | 2 780 348 | A1 | 12/1999 |
| FR | 2 780 454 | A1 | 12/1999 |
| WO | WO 81/03201 | A1 | 11/1981 |

* cited by examiner

HOUSING OF A CENTRIFUGAL BLOWER

This nonprovisional application claims priority under 35 U.S.C. § 119(a) to German Patent Application No. 10 2014 206 114.8, which was filed in Germany on Apr. 1, 2014, and which is herein incorporated by reference.

BACKGROUND OF THE INVENTION

Field of the Invention

The present invention relates to a housing of a centrifugal blower for use in an air conditioner, including a rotatably supported fan wheel, including an inlet opening disposed in an axial direction of the fan wheel and an outlet opening disposed in a radial direction of the fan wheel, a widening diffuser being disposed downstream from the outlet opening in a flow direction, and the fan wheel being disposed in an inner volume of the housing.

Description of the Background Art

Blowers are used in air conditioners to guide fluid flows through the individual elements of the air conditioner. The fluid flows through flow channels, diffusers, heat exchangers and outlet nozzles, among other components.

Acoustic interference noises, which may negatively impair passenger comfort, may arise, in particular, in the area of the blower, which conveys the air flow into the evaporator area of the air conditioner. Centrifugal blowers, which suck in the air in an axial direction and finally blow it out in a radial direction, are regularly used as blowers. To increase the pressure of the air, a diffuser may be connected downstream from the blower in the flow direction.

The interference noises include, in particular, level-determining peaks in the range of 200 Hz to 500 Hz. These peaks are regularly amplified by the special transmission function of an assembly comprising a blower, a diffuser and an evaporator area, whereby the intensity of the noises increases.

A wide range of measures are known in the conventional art, which are aimed at reducing the development of interference noise in or on the blowers for the purpose of producing a preferably high passenger comfort. Foam parts or conductive elements, for example, are known for this purpose, which are mounted on the blower for the purpose of optimizing the air flow. Alternatively, sound dampers are used for the purpose of reducing the developing noises. Helmholtz resonators are also proposed in the literature for the purpose of achieving a reduction in noise.

Perforated plates are proposed in the publications FR 2 780 454 and FR 2 780 348, which are introduced into the air flow at a point downstream from the blower in the flow direction.

The disadvantage of the approaches according to the prior art is, in particular, that significantly higher costs are incurred through the use of the aforementioned measures. Additional pressure losses are also produced, and a reduction in the flow cross section is induced.

SUMMARY OF THE INVENTION

It is therefore an object of the present invention to provide a housing of a centrifugal blower, which facilitates an improved damping of the developing interference noises and simultaneously causes only the smallest possible impairments with regard to the pressure loss. The housing should also require as little installation space as possible.

The object of the invention is furthermore to provide an air conditioner which includes a centrifugal blower having an improved housing.

An exemplary embodiment of the invention relates to a housing of a centrifugal blower for use in an air conditioner, including a rotatably supported fan wheel, an inlet opening disposed in an axial direction of the fan wheel and an outlet opening disposed in the radial direction of the fan wheel, a widening diffuser being disposed downstream from the outlet opening in the flow direction, and the fan wheel being disposed in an inner volume of the housing, a crossover area formed from multiple openings being provided on at least one housing wall which delimits the inner volume, and at least one chamber being disposed on the outside of the housing, the chamber completely covering the crossover area and being fluidically connected to the inner volume of the housing via the crossover area.

The inner volume designates the volume in the interior of the housing, into which the fan wheel may be inserted. This volume is formed by an essentially scroll-shaped cross section. The arrangement of chambers on the outer circumference of the housing is advantageous, since sound pressure fluctuations generated by the fan wheel are able to enter the chamber, whereby an acoustic calming of the air flow may be achieved. The chamber having the perforated crossover area acts as a sound damper.

The chamber and the crossover area can be disposed on a wall which delimits the housing in the radial direction, and/or on a wall which delimits the housing in the axial direction. This is particularly advantageous, since the chambers are thereby connected to the housing directly and not via additional flow channels.

The chamber can be divided into multiple subchambers by separating elements, each of the subchambers being fluidically connected to the inner volume of the housing via at least one section of the crossover area. Dividing the chamber into multiple subchambers is particularly advantageous, since the individual subchambers may be individually adapted, with respect to their size and cross section, to the particular frequency to be damped. At the same time, the structure is very simple, due to the shared cover.

The outlet opening disposed in the radial direction can be formed by a channel section which merges with a widening diffuser. This is particularly advantageous to produce a preferably stepless transition from the inner volume into the diffuser.

The chamber can be formed by a box-like, cuboid cover, which is connected to a wall delimiting the housing in the radial direction and/or to a wall delimiting the housing in the axial direction. A box-like cover is particularly advantageous, since is may be easily produced. The cover may be easily mounted from the outside onto one of the outer surfaces of the housing, due to its box-like structure. The cover thus has preferably three abutting walls in cross section, which are perpendicular to each other, while the fourth wall is formed by the crossover area.

In exemplary embodiment the inner volume of the housing can have a scroll-shaped cross section with a block dimension, the chamber having a depth and a height, the depth and the height preferably being in a range between 0 and three times the block dimension.

The depth and width in this case are, for example, the extensions of the chamber in the radial direction. However, the third dimension, the height forms the extension in the axial direction. Depending on the depth, width and height, the inner volume of the chamber may be easily influenced, whereby the damping properties of the chamber may be changed.

The chamber can have a width $B_1$, width $B_1$ being measured in the axial direction of the fan wheel, width $B_1$ of the chamber being preferably in a range between 0 and four times opening width $B_0$ of the outlet opening in the axial direction. A height of the chamber, which is within the aforementioned ranges, is particularly advantageous to be able to achieve an advantageous damping of the interference noises, without producing significant pressure losses.

In an embodiment of the invention, it is also provided that the crossover area can be formed by a perforated plate and/or a slotted plate. The crossover area may be advantageously injection-molded as a single piece with the rest of the housing. Alternatively, elements such as perforated plates may be inserted into a large recess in the housing wall and connected thereto for the purpose of producing the crossover area. The openings may be disposed in different advantageous configurations, depending on the vibration to be damped and the available installation space.

In an embodiment of the invention, it may be provided that the crossover area can be disposed on a wall which delimits the housing in the radial direction as well as on a wall which delimits the outlet opening and/or on a wall of the diffuser. In this case, a separation between two chambers is necessary to prevent reflows from the diffuser area into the scroll housing.

Depending on the frequency to be damped, the chamber may be disposed at different points on the housing. The air which may be conveyed by the fan wheel into the interior of the housing usually has different states and properties at different points in the housing, and the development of interference noises may therefore also take place at different points in the housing. The chamber is therefore advantageously disposed at the point which promises the best results with regard to the frequency to be damped.

The chamber can be disposed on an end area of the housing opposite the outlet opening. This may be particularly advantageous, depending on the frequency to be damped. Factors such as pressure, flow velocity, the inner volume of the housing and the chamber or the frequency to be damped, among other things, play an important role in the arrangement and dimensioning of the chamber.

Moreover, the housing can be delimited in the radial direction by a scroll-shaped wall, the crossover area extending from 0 degrees to 180 degrees, preferably from 90 degrees to 180 degrees, over a scroll section of the scroll-shaped wall. It is particularly advantageous if the entire crossover area is covered by the chamber to avoid unwanted outflow of the air outside the housing. Depending on the frequency to be damped, it may be advantageous if the transfer of the sound waves from the inner volume into the chamber takes place either via the longest possible scroll section of the housing wall or via the shortest possible circle arc section. However, an excessively long scroll section should be avoided for the crossover area to prevent a backup of air in the chamber and to minimize possible disturbing influences, for example an increased pressure loss due to the chamber.

Another exemplary embodiment can have at least two chambers and two crossover areas provided, the chambers being disposed opposite each other on the housing.

The volume enclosed by the chamber and/or the cross-sectional area of the outlet opening can be defined as a function of a frequency range to be damped. It is particularly advantageous in this case if the chamber is designed as a function of the frequencies of the particular interference noises to be damped, since a preferably optimum damping of the disturbing noises is facilitated thereby.

An exemplary embodiment of the invention relates to an air conditioning which includes a centrifugal blower, the centrifugal blower being disposed in a housing according to the invention. An air conditioner of this type is particularly advantageous for the purpose of reducing the development of acoustic interference noises resulting from the blower. This results in a lesser impairment of passenger comfort, whereby the quality impression of the vehicle is increased overall.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
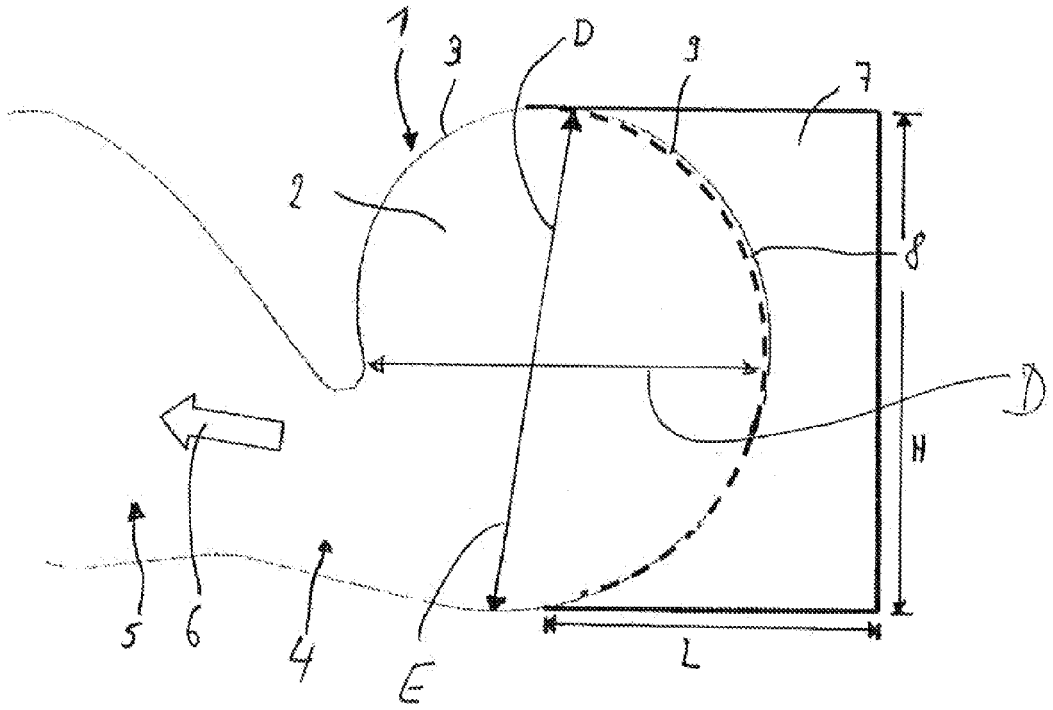
FIG. 1 shows a sectional view of a housing for a centrifugal blower, a box-shaped chamber being disposed on a wall which delimits the receiving space of the fan wheel in the radial direction and being fluidically connected to the inner volume of the housing by a crossover area in the wall.

FIG. 1 shows a cross sectional view of a housing 1 of a centrifugal blower. Housing 1 encompasses an inner volume 2, which, in the cross-sectional view, is essentially scroll-shaped, and which has an outlet opening 4 in its lower left end area. A fan wheel (not illustrated) may be disposed in a rotatably supported manner within this scroll-shaped inner volume 2. With the aid of the fan wheel, an air flow may be conveyed in the axial direction and blown out in the radial direction along outlet opening 4 into diffuser 5 along air flow direction 6. The axial directly corresponds to a normal to the surface on the drawing plane.

Together with outlet opening 4 and the transition to diffuser 5, the scroll-shaped area of inner volume 2 forms the scroll housing of the centrifugal blower. The essentially scroll-shaped area of inner volume 2 has a block dimension D. The fan wheel, which is not illustrated in FIG. 1, has a circular cross section and a diameter which is smaller than block dimension D of housing 1. As a result, the fan wheel is freely rotatably within housing 1.

Housing 1 has a wall 3, which circumferentially delimits inner volume 2 in the radial direction. The housing furthermore has walls 28, which delimit inner volume 2 in the axial direction. These walls are not illustrated in FIGS. 1 through 4, due to the sectional views.

One part of radial wall 3 is formed by a crossover area 8 in FIG. 1. This crossover area 8 has a plurality of openings 9 disposed adjacent to each other. Radially delimiting wall 3 is thus permeable to sound waves in the area of crossover area 8, in particular for reasons of improving the acoustics.

Openings 9 may have a circular or slotted shape, among others. The openings are used to permit a transfer of sound waves from inner volume 2 into chamber 7 connected to housing 1.

Chamber 7 is formed by a box-like, cuboid cover, which is connected to an outer wall of housing 1. Chamber 7 encompasses entire crossover area 8, so that all openings 9 permit an acoustic communication between inner volume 2 and chamber 7.

Chamber 7 essentially has two extension on the drawing plane, extension L representing the depth of the chamber and extension H representing the height of chamber 7. The two extensions L and H each extend in the radial direction of housing 1. The third dimension of chamber 7 represents width B, which is not illustrated in FIG. 1, width B running in the axial direction, i.e., normal to the surface on the drawing plane.

Chamber 7 thus has an inner volume which is delimited by the walls of chamber 7. Chamber 7 is used to provide a transition area, in which sound pressure fluctuations may cross over from inner volume 2 of housing 1. The noise development caused by the operation of the centrifugal blower is to be reduced in this manner. Due to the adaptation of the inner volume of chamber 7 as well as the size of crossover area 8 or the arrangement and size of openings 9, a damping may be achieved for different frequency ranges of the interference noises arising during operation. In particular, the combination of a crossover area 8 having multiple openings 9 and an additional volume, due to chamber 7, forms an advantageous combination in this case, with the aid of which interference noises of various frequencies may be damped in a highly targeted manner. Chamber 7 as well as crossover area 8 and openings 9 may each be adapted accordingly to the special centrifugal blower. Chamber 7 is used as a noise damper.

In alternative specific embodiments, chamber 7 may also be disposed at another point on the circumference of housing 1.

Figure 2:
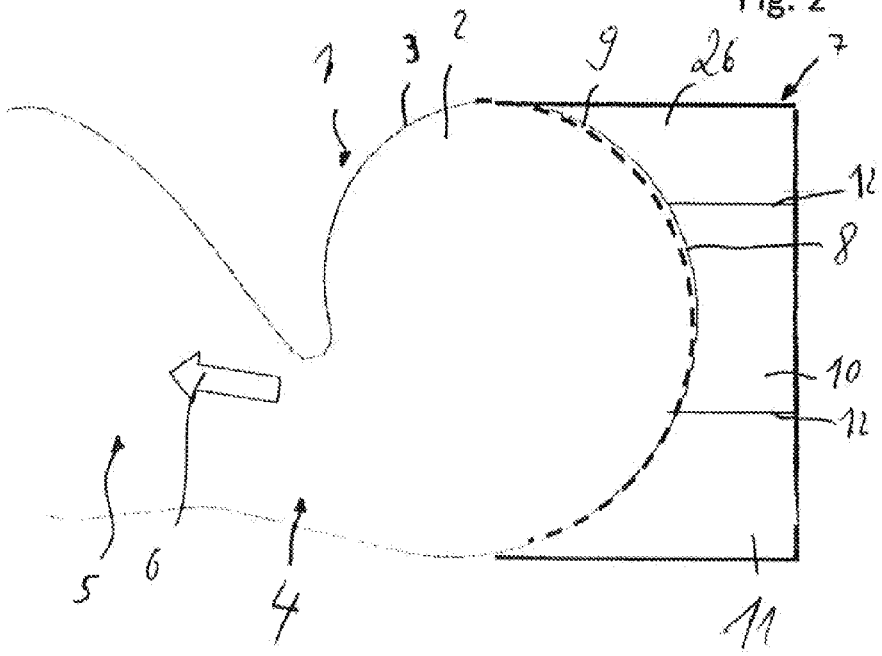
FIG. 2 shows a sectional view according to FIG. 1, the connected chamber being divided into multiple subchambers by a separator.

FIG. 2 shows a view of a housing having a chamber 7, as already shown in FIG. 1. Chamber 7 is additionally divided into three subchambers 10, 11 and 26 by two separators 12, which run parallel to each other in the illustration in FIG. 2. Each of subchambers 10, 11 and 26 is in fluidic communication with inner volume 2 of housing 1 via crossover area 8 or openings 9. A damping of different interference noises may be achieved due to the design of individual subchambers 10, 11 and 26. In one alternative embodiment, separating elements 12 may also be oriented in such a way that, as the distance from inner volume 2 increases, the cross sections of the individual subchambers increase or decrease in size by positioning the separating elements, for example, at an angle. Alternatively, bow-shaped separating elements may also be provided.

Figure 3:
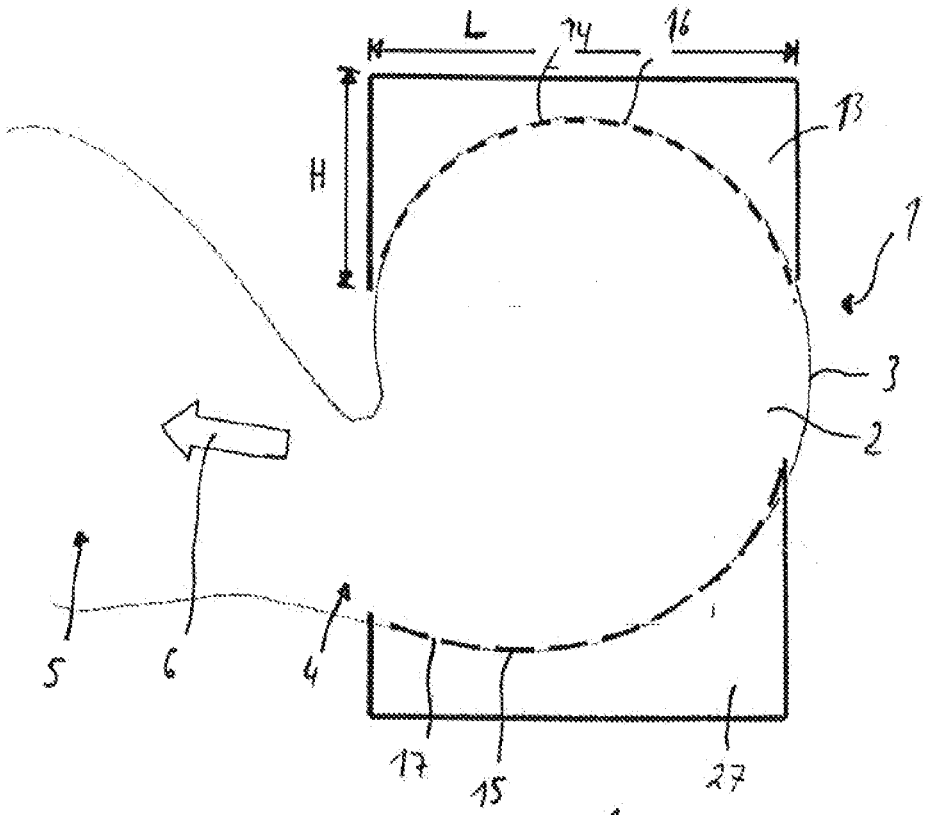
FIG. 3 shows a sectional view of a housing according to FIG. 1, two opposite chambers being connected to the wall which limits the inner volume in the radial direction, the wall having a separate crossover area for each of the chambers.

FIG. 3 shows a housing 1, which was illustrated above in preceding FIGS. 1 and 2. In contrast to FIGS. 1 and 2, two chambers 13, 27 are now disposed on the outer circumference of housing 1 in FIG. 3. Chambers 13 and 27 have a cross section corresponding to chamber 7. This means that they are also formed by a box-like, cuboid cover, which is connected to an outer wall of housing 1. The two chambers 13, 27 are connected to radial wall 3 at opposite end areas of housing 1. Upper chamber 13 is in fluidic communication with inner volume 2 via crossover area 14, which has openings 16. Lower chamber 27 is in fluidic communication with the inner volume via crossover area 15, which has openings 17. The two chambers, 13, 27 each have a height H and a depth L, corresponding to FIG. 1.

Transfer areas 14 and 15 essentially differ from each other by the distance of openings 16, 17 from each other. The distance of openings 17 from each other is selected to be larger in crossover area 15 than in crossover area 14. This arrangement of openings 16, 17 shows a possible variation of particular crossover areas 14, 17.

In alternative specific embodiments, chambers 13, 27 may also be disposed at an arbitrary point on the circumference of housing 1. In particular, chambers 13, 27 do not have to be situated opposite each other. The inner volumes of chambers 13, 27 may also deviate significantly from each other, depending on the frequencies to be damped, so that a larger and a smaller chamber may be provided. In alternative specific embodiments, an outer wall which deviates from the box-like, cuboid cover may also be provided for the individual chambers. For example, spherical or bow-shaped chambers may also be provided.

Figure 4:
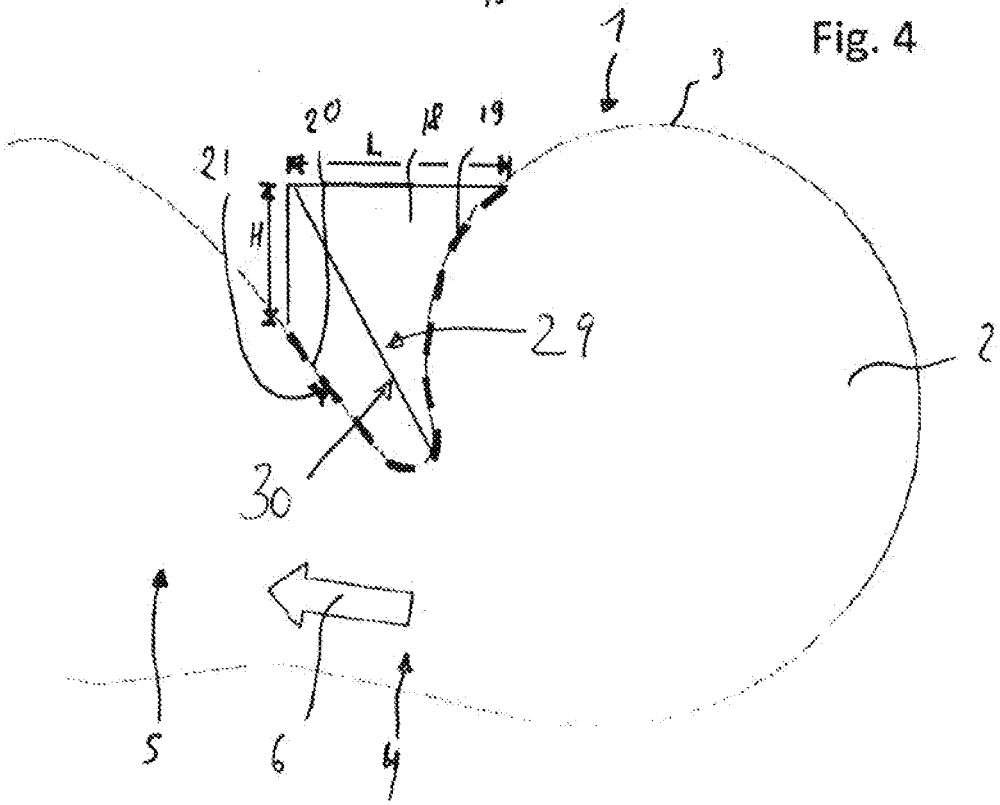
FIG. 4 shows another sectional view of a housing according to FIG. 1, the crossover area being disposed at the transition between an inner volume and the widening diffuser, which is situated downstream from the outlet opening.

FIG. 4 shows another view of a housing 1, as in preceding FIGS. 1 through 3. Chamber 18 in FIG. 4 is disposed on a section of radial wall 3 as well as on a wall 21, which delimits widening diffuser 5. As a result, the sound wave transfer between inner volume 2 and chamber 18 may take place via crossover area 9 along opening 20 in the area of outlet opening 4 and diffuser 5. The indented area, which forms the transition from radial wall 3 to the wall of diffuser 5, is also referred to as the volute tongue. Chamber 18 contains a separator 29, which prevents an overflow of air from diffuser 5 into scroll volume 2.

One exemplary embodiment of chamber 18 may likewise be combined with additional chambers, as has been illustrated in the preceding FIGS. 1 through 3. All chambers shown in FIGS. 1 through 4 may have the same longitudinal extension in the axial direction as housing 1, or they may also have a shorter or a longer extension.

Figure 5:
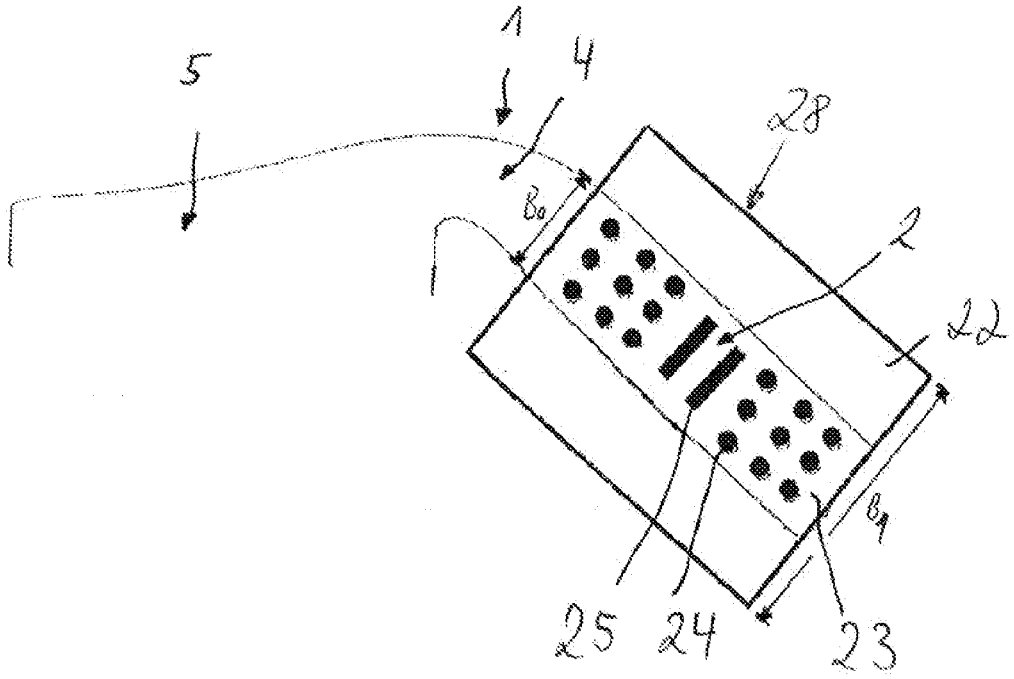
FIG. 5 shows a sectional view of a housing according to FIGS. 1 through 4, the section running through the housing in the axial direction.
Figure 6:
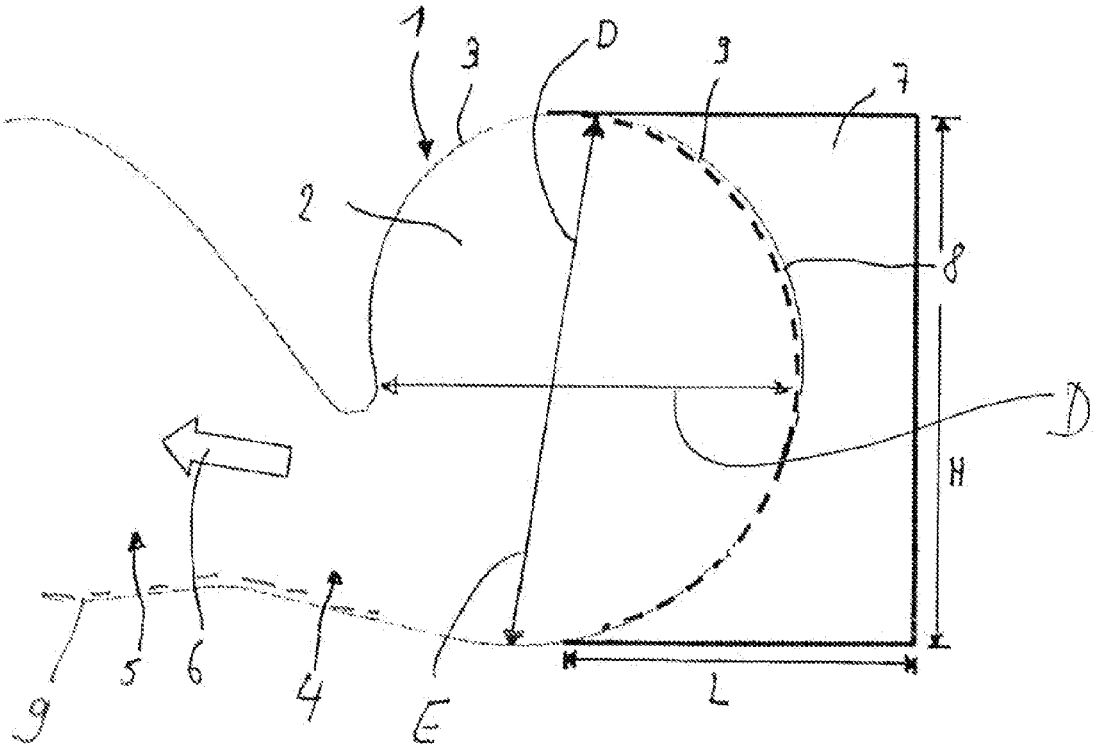
FIG. 6 shows a sectional view of the housing.
Figure 7:
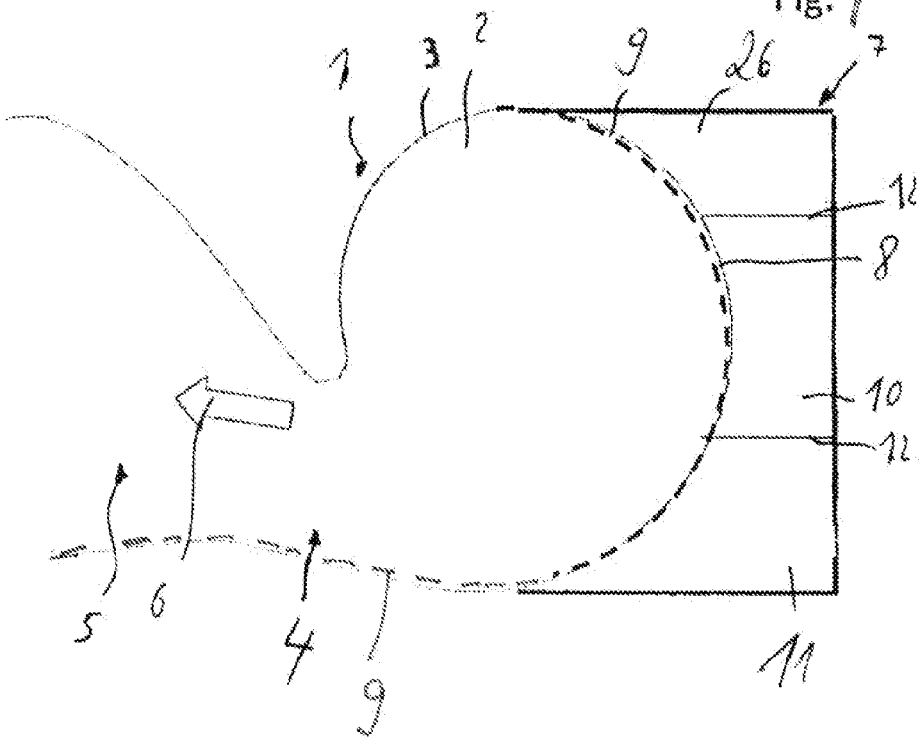
FIG. 7 shows another sectional view of the housing.

FIG. 5 shows an alternative view of a housing 1, with a chamber 22 disposed thereon. FIG. 5 represents a sectional view of housing 1 in the axial direction.

Chamber 22, which is connected to housing 1, is illustrated in FIG. 5 and has a width $B_1$, in particular in the axial direction, which is greater than width $B_0$, which describes the height of outlet opening 4. The area of housing 1 which forms inner volume 2, may have either a width corresponding to width $B_0$ of the outlet opening or a value deviating therefrom up to a maximum width $B_1$ of chamber 22.

A crossover area 23, which is formed by an area having both circular openings 24 and slotted openings 25, is provided from inner volume 2 into chamber 22. Transfer area 23 represents a possible variation for crossover areas. Other shapes may also be provided for openings 24, 25 in addition to the shapes of openings 24 and 25 shown in FIG. 5. Width $B_1$ of chamber 22 is preferably in a range between 0 and four times width $B_0$ of outlet opening 4.

The exemplary embodiments illustrated in FIGS. 1 through 5 are only examples and have no limiting effect, in particular with regard to the size, dimensioning and shape of the chambers and the crossover areas. FIGS. 1 through 5 are used to clarify the idea of the invention, which provides, in particular, the combination of a crossover area having a plurality of openings and a chamber connected thereto for the purpose of damping interference noises. The chambers may be disposed, in particular, in the radial direction of the housing. However, an arrangement of a chamber in the axial direction of the housing may also be provided. Likewise, a combination of radially oriented chambers and axially oriented chambers may be provided. The arrangement of chambers, the size design of the chambers, the design of the crossover area and the arrangement of the openings are dependent, in particular, on the interference noise to be damped in each case.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A housing for a centrifugal blower for use in an air conditioner, the housing comprising:

walls that delimit an inner volume of the housing;

a rotatably supported fan wheel disposed in the inner volume of the housing;

an inlet opening disposed in an axial direction of the fan wheel;

an outlet opening disposed in a radial direction of the fan wheel;

a widening diffuser disposed downstream from the outlet opening in a flow direction;

a crossover area formed from multiple openings and arranged on at least one of the walls that delimit the inner volume; and at least one chamber disposed on an outside of the housing, the chamber completely covering only the crossover area and being fluidically connected to the inner volume of the housing via the crossover area, such that only a portion of the walls that delimit the inner volume of the housing are covered, wherein, the crossover area is provided downstream of the inlet opening and upstream of the outlet opening, such that the openings of the crossover area open directly into the inner volume, and wherein the crossover area is provided solely to one side of the housing, the one side of the housing opposing a side of the housing to which the outlet opening is provided.

2. The housing according to claim 1, wherein the walls that delimit the inner volume include a wall that delimits the inner volume of the housing in a radial direction and a wall that delimits the inner volume of the housing in an axial direction, and wherein the chamber and the crossover area are disposed on the wall that delimits the inner volume of the housing in the radial direction and/or on the wall that delimits the inner volume of the housing in the axial direction.

3. The housing according to claim 1, wherein the chamber is divided into multiple subchambers by separating elements, each of the subchambers being fluidically connected to the inner volume of the housing via at least one section of the crossover area.

4. The housing according to claim 1, wherein the walls that delimit the inner volume include a wall that delimits the inner volume of the housing in a radial direction and a wall that delimits the inner volume of the housing in an axial direction, and wherein the chamber is formed by a box shaped cuboid cover that is connected to the wall that delimits the inner volume of the housing in the radial direction or to the wall that delimits the inner volume of the housing in the axial direction.

5. The housing according to claim 1, wherein the inner volume of the housing has a scroll-shaped cross section with a block dimension, wherein the chamber has a depth and a height, the depth and the height being in a range between 0 and three times the block dimension.

6. The housing according to claim 1, wherein the chamber has a width, the width being measured in the axial direction of the fan wheel, the width of the chamber being in a range between 0 and four times an opening width of the outlet opening in the axial direction.

7. The housing according to claim 1, wherein the crossover area is formed by a perforated plate and/or a slotted plate.

8. The housing according to claim 1, wherein the housing is delimited in the radial direction by a scroll-shaped wall, wherein the crossover area extends over a circular arc section of the scroll-shaped wall by 0 degrees to 180 degrees or by 90 degrees to 180 degrees.

9. The housing according to claim 1, wherein the volume encompassed by the chamber and a cross sectional area of each of the openings are determined based on a frequency range to be damped.

* * * * *